US006481510B1

(12) United States Patent
Desmarais et al.

(10) Patent No.: US 6,481,510 B1
(45) Date of Patent: Nov. 19, 2002

(54) DIRECTIONAL DRILL FOR RAILWAY DRILLING AND METHOD OF USING SAME

(75) Inventors: Lionel Charles Desmarais, Bolton; Bernie A. Stene, Landsdowne, both of (CA)

(73) Assignee: 360fiber ltd,, Mississauga (CA)

( * ) Notice: Subject to any disclaimer, the term of this patent is extended or adjusted under 35 U.S.C. 154(b) by 0 days.

(21) Appl. No.: 09/580,736

(22) Filed: May 26, 2000

(51) Int. Cl.[7] ..... E21B 7/04; E21B 19/20; E21B 3/02

(52) U.S. Cl. ..... 175/61; 175/85; 175/102; 175/203; 175/219; 173/185

(58) Field of Search ..... 175/61, 85, 162, 175/202, 203, 219, 220; 173/185

(56) References Cited

U.S. PATENT DOCUMENTS

| | | | | | |
|---|---|---|---|---|---|
| 773,112 | A | * | 10/1904 | Adams | 173/26 |
| 1,180,554 | A | * | 4/1916 | Stueber | 408/46 |
| 2,396,365 | A | * | 3/1946 | Fuecht | 182/141 |
| 3,411,596 | A | * | 11/1968 | Robbins | 175/85 |
| 4,371,041 | A | * | 2/1983 | Becker et al. | 173/28 |
| 4,957,173 | A | * | 9/1990 | Kinnan | 175/61 |
| 5,213,169 | A | * | 5/1993 | Heller | 175/122 |
| 5,449,046 | A | * | 9/1995 | Kinnan | 175/24 |
| 5,553,680 | A | * | 9/1996 | Hathaway | 175/78 |
| 5,803,189 | A | * | 9/1998 | Geldner | 175/113 |
| 5,941,320 | A | * | 8/1999 | Austin et al. | 175/27 |
| 6,109,371 | A | * | 8/2000 | Kinnan | 175/61 |
| 6,179,065 | B1 | * | 1/2001 | Payne et al. | 175/24 |
| 6,189,628 | B1 | * | 2/2001 | Jenne | 175/52 |
| 6,227,311 | B1 | * | 5/2001 | Osadchuk | 175/53 |
| 6,237,703 | B1 | * | 5/2001 | Draney et al. | 175/162 |

OTHER PUBLICATIONS

Color photograph of a directional drill. Date unknown but at least as early as May 25, 1999.

* cited by examiner

*Primary Examiner*—David Bagnell
*Assistant Examiner*—Jennifer H Gray
(74) *Attorney, Agent, or Firm*—John Russel Uren

(57) ABSTRACT

A directional drill for transport via rail tracks and railwheels associated with the directional drill to an operating location. The directional drill has a first frame associated with a set of pneumatic tires for movement of the directional drill onto and off of the tracks and, when removed from the tracks, for movement to the operating location. A second frame is rotatably attached to the first frame and allows the drilling configuration of the second frame to be more nearly horizontal relative to the first frame. Hydraulic lines move during drilling and are maintained in a predetermined configuration to reduce vibration and chaffing.

11 Claims, 2 Drawing Sheets

DIRECTIONAL DRILL FOR RAILWAY DRILLING AND METHOD OF USING SAME

INTRODUCTION

This invention relates to a directional drill and, more particularly, to a directional drill specifically adapted for railway related applications.

BACKGROUND OF THE INVENTION

Directional drills are, of course, well known, principally in the oil and gas industry and for underground pipe laying applications. In such applications, the drill generally introduces the drill string to the surface of the ground at an acute angle. A directional drill bit is used at the head of the drill string. It's location underground may be determined by a locator and its position changed so that the drill bit may be guided along a desired course underground, typically toward an area of interest which area may hold an oil or gas deposit. Other directional drills may be used for drilling a hole over a relatively small distance without a guided drill bit where any unforeseen obstacles are generally not present and the drill bit need not be guided.

All of the above-identified drills have a common characteristic, however. They may choose their location to set up and install the drilling apparatus. The location for setting up a drilling apparatus for oil and gas will be selected with care and much flexibility is present. The is drilling apparatus is not readily transportable with many hours being needed for setting up and removing the drilling apparatus. Generally, therefore, the drilling apparatuses are all located on relatively horizontal ground surfaces with ample area for installing the drilling apparatus extending around the drilling location.

In recent years, the laying of fiber optic telecommunications cable along railway right-of-way has been undertaken with success as a collaborative venture between the owners of the right-of-way, generally railways, and the owners of the fiber optic cable network. The right-of-way avoids the necessity of purchasing rights for the cable network. In return for allowing the railway area to be used for carrying the fiber optic cables, the railway generally obtains the right to carry some of its data over a line or lines. The fiber optic cable is then laid within or under the ballast of the railway. Such cable networks can be extensive, extending from coast to coast and generally following the railway lines. Such fiber optic cables may be appropriately installed in certain areas by drilling a hole into which the cable sheathing is positioned to pass an obstacle or otherwise to place the cable underground where it will not be disturbed.

The drilling apparatuses identified above, however, are not appropriate for such fiber optic cable laying activities in settings adjacent to railway track. First, the apparatuses must be portable and able to quickly move from position to position since trains may be using the track about which the drilling activity is being conducted. Second, the apparatuses must be transportable along the railway track itself since the only efficient way to move the apparatuses may be by the rails. Third, since the ballast beneath the rails may be configured with a slope downwardly from the track, previous apparatuses are unable to work on such slopes in a configuration in which the drill itself is generally horizontal which is necessary for the drilling operation itself.

SUMMARY OF THE INVENTION

According to one aspect of the invention, there is provided a directional drill for drilling a hole beneath a ground surface, said drill comprising a drill head mounted to apply rotary motion to drill pipe and longitudinal pressure on one end of said drill pipe during the drilling operation, said drill head applying rotary motion to said drill pipe and longitudinal pressure on one end of said drill pipe when said pipe is withdrawn from said drill hole, said drill head moving from a first position on a rack wherein said drill pipe first enters said hole being drilled to a second position on said rack when said pipe is further within said hole being drilled, said directional drill having a frame and a set of tires mounted on a subframe, said frame being rotatable relative to said subframe o over a predetermined angle and about a longitudinal axis of said drilling apparatus.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
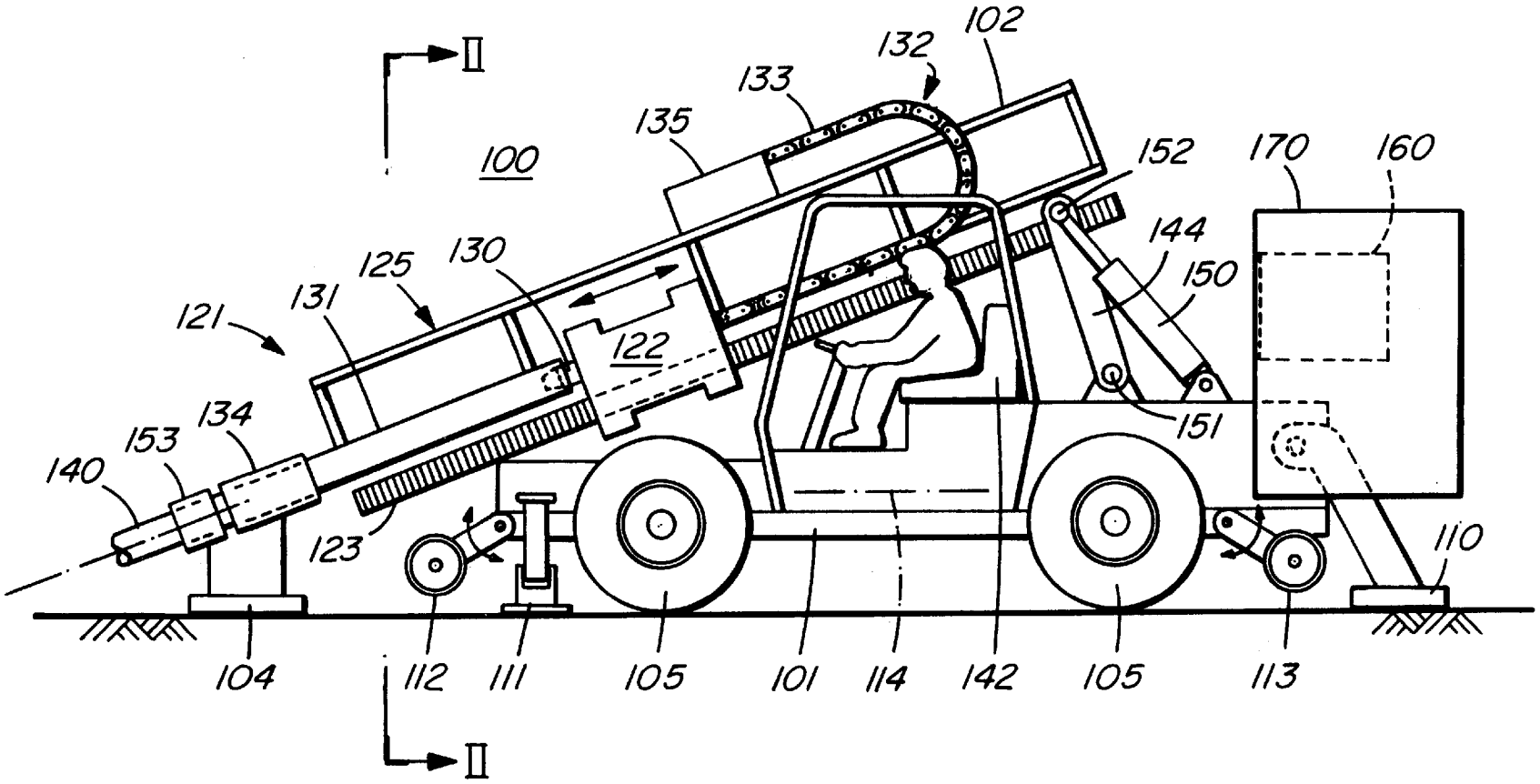
FIG. 1 is a diagrammatic side view of a directional drilling apparatus according to a first aspect of the invention.

Referring now to the drawings, the directional drill according to the invention is generally illustrated at 100 in FIG. 1. It comprises a first of lower frame 101 mounted on rubber tires 105 and a second or upper frame 102 Generally, the lower frame 101 contains the running gear used for driving the directional drill 100 from location to location. The running gear includes the front and rear axles 103 and the transmission (not illustrated) used to drive the front and rear axles 103. The lower frame 101 also includes the front and rear anchors 104, 110 which are used to maintain the drill 100 in its operating configuration and jacks 111 which are extendible and which are used to allow more force to be transferred from the directional drill 100 directly to the ground and thereby remove a significant amount of force and vibration from being transferred through the frame to the operator and other components.

A pair of hydraulically extendible front railwheels 112 are mounted to the forward portion of lower frame 101 and a second pair of hydraulically extendible rear railwheels 113 are mounted to the rearward portion of lower frame 101. The railwheels 113 are used to allow transportation of the directional drill 100 on railway tracks.

Figure 2:
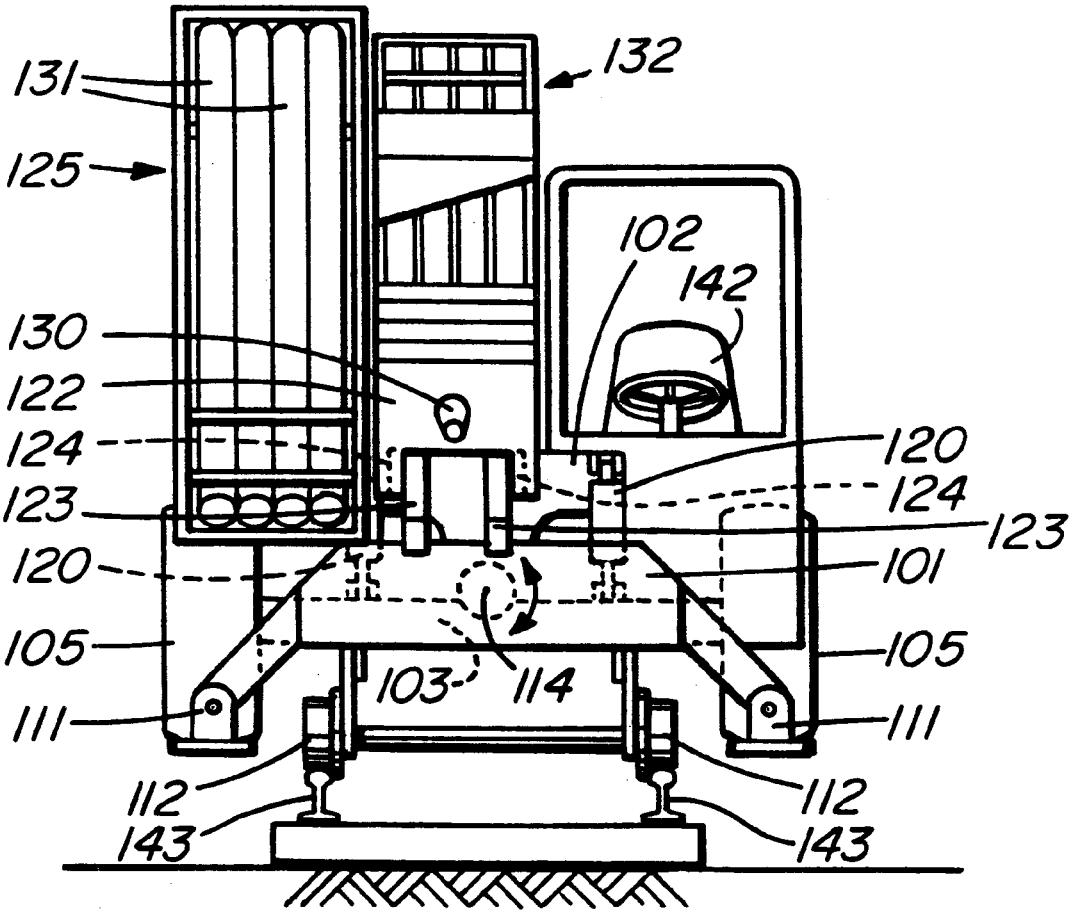
FIG. 2 is a front view of the drilling apparatus of FIG. 1 taken along II—II of FIG. 1.

Second or upper frame 102 is rotatable relative to first or lower frame 101 as best seen in FIG. 2 about longitudinal axis 114. Hydraulic cylinders 120 may rotate the upper frame 102 a predetermined rotational distance, conveniently plus or minus 10 degrees, relative to the lower frame 101 for purposes as will be described hereafter.

The drill itself is shown generally at 121. It comprises a rotary drill head 122 mounted on a two sided rack 123 and movable on the rack 123 by means of pinion gears 124 which mesh with the rack 123 and are hydraulically driven to reciprocate the rotary drill head 122 on the rack 123 during the drilling and pipe removal operation.

The rotary, drill head 122 includes a male connector 130 which mates with the female connections on the drill pipes 131. Male connector 130 is rotated is hydraulically to provide rotational movement to the drill pipes 131.

Numerous hydraulic lines generally illustrated at 132 extend between a manifold 135 and the rotary drill head 122.

Since the rotary drill head 122 is moving continuously during operation, the hydraulic lines are likewise moving between the manifold 135 and the drill head 122. To maintain the lines in order and to reduce vibration of the lines 132 during operation, a chain link 133 similarly extends from the manifold 135 to the rotary drill head 122. This chain link 133 is two sided (FIG. 2) and has a frame network that allows the hydraulic lines 132 to be separated from each other and which maintains them in the chain line 133 during operation Reduction or elimination of chaffing of the hydraulic lines 132 results from the chain link 133.

A guide 134 is mounted on the forward end of the drill 121. The guide 134 maintains the pipe 131 within the guide during operation and thereby reduces the amplitude of movement away from the central axis 140 of the pipe 131 during operation.

An engine 170 to power the directional drill 100 and all of its components is mounted rearwardly of the drill 100. The engine used is conveniently a diesel engine manufactured by CATERPILLAR (Trademark) with generates 240 horsepower.

An operators cab 141 is provided. Cab 141 contains the controls for operating the directional drill 100 and a seat 142 is provided to allow the operator comfortable access to the operating controls of the directional drill 100.

A pipe rack generally illustrated at 125 is located adjacent the rotary drill head 122. The pipe rack 125 allows for storage of the drill pipes 131 which are added to or removed from the rotary drill head 122 during operation. The pipe removal operation is accomplished by gripper arms (not illustrated) which, after removal of the male connector 130 from the female connection of the drill pipe 131 and after removal of the forward end of the drill pipe 131 from the guide 134, will grasp the pipe 131, move it from the drilling position between guide 134 and male connector 131 and place it in the pipe rack 125. Likewise, during placement of the drill pipe 131 in the drill string during the drilling operation, the gripper arms will move pipe 131 from its position in the pipe rack 125 to the position between the rotary drill head 122 and the guide 134 where it is connected to the drill string and male connector 130. The movement of the drill pipe 131 from the drill string to the pipe rack 125 and vice versa is well known to those skilled in the art and is not described in detail.

The drill 121 and its associated components including the pipe rack 125 are hydraulically movable from an operating configuration to a transport configuration. Frame arms 144 are connected between the upper frame 101 and the drill 121. Hydraulic cylinders 150 are provided to rotate the frame arms 144 about axes 151, 152. By rotating arms 144 with hydraulic cylinders 150 clockwise as viewed in FIG. 1, the rear end of drill 121 adjacent the frame arms 144 moves rearwardly and downwardly and the front end of drill 121 moves rearwardly and upwardly. This movement defines the position of the directional drill 100 in its transport condition. Likewise, the movement of the frame arms 144 counterclockwise as viewed in FIG. 1 defines the position of the directional drill 100 in its operating configuration.

A mud tank 160 is provided adjacent the engine 140. Fluid is pumped from the mud tank 160 through the center of the male connector 130 and into the drill pipe 131. The drilling fluid from tank 160 lubricates the drill bit connected to the most forwardly end of the drill string and thereby allows for more efficient drilling.

OPERATION

It will initially be assumed that the directional drill 100 according to the invention is being transported to an operating position on rail tracks 143 (FIG. 2). When the operating location is reached the rail wheels 112 are hydraulically lifted thereby removing them from contact with the tracks 143 and with the pneumatic tires 105 carrying the entire weight of the directional drill 100. The operating position of the drill is selected by the operator and the directional drill 100 is driven off the tracks 143 to the operating position.

Although convenient, it is not necessary that the operating position be horizontal. Indeed, due to the great variety of terrain through which railway tracks pass, the operating position is usually not horizontal. To allow the drill 121 and the components related thereto to assume a horizontal position, the operator may move the upper frame 102 a limited rotational distance about axis 114, conveniently plus or minus 10 degrees, as indicated in FIG. 2 so as to allow the drill 121 to assume a generally horizontal position during the drilling operation.

Once the required rotational movement is completed for horizontal operation of the drill 121, frame arms 144 are moved by hydraulic cylinders 150 to raise the rear end of the drill and to lower the front end of the drill 121 while simultaneously moving the drill 121 forwardly from its transport position.

When the desired operating configuration is reached, the outriggers 111 and the anchors 104, 110 which are each connected to lower frame 101 are extended for stability purposes. The outriggers 111 on each side of the directional drill 100 are individually adjustable depending on the distance of the ground contact position.

The operator will then commence the drilling operation by moving the rotating drill head 122 to its most rearwardly position on rack 123.

A drill pipe 131 will be removed from the pipe rack 125 by gripper arms (not illustrated) and positioned between the male connector 130 and within the guide 134. The tongs 153 which are part of guide 134 seize the drill pipe 131 and prevent rotation of the pipe 131 while the male connector 130 moves into and joins up with the female end of the drill pipe 131. A drill bit (not illustrated) is connected to the forward end of the initial piece of drill pipe 131 as in known.

Following the connection between the male connector 130 and the drill pipe 131, the tongs 153 release the drill pipe and the drill bit is placed into position for ground entry and spudded in. The drilling operation is then underway with the rotary drill head 122 providing forward pressure on the drill pipe 131 and the bit as the hydraulically driven pinions 124 rotate on rack 123 and the rotary drill head 122 moves downwardly and forwardly relative to rack 123.

When the rearward end of the initial piece of drill pipe 131 is adjacent the guide 134, the tongs 153 are tightened on the drill pipe 131 to maintain it in place and the male connector 130 is rotated in an opposite direction thereby to break the connection between the male connector 130 and the drill pipe 131.

Following the break of the connection, the operator will move the rotary drill head 122 rearwardly on the rack 122 by reversing the rotation of the pinion gears 124 until the most rearwardly position of the rotary drill head 122 on the rack 123 is reached. A second piece of drill pipe 131 will be removed from the pipe rack 125 by the gripper arms and placed in position between the guide 134 and the male connector 130. The pin end of the newly positioned drill pipe will be placed in the female end of the previous drill pipe being held by the tongs 153. The operator will conveniently manually apply a lubricant to the male connector 130 and move the rotary drill head 130 forwardly until the male connector 130 is fully connected with the female end of the newly placed drill pipe. Rotation of the male connector will continue until the coupling between the pin end of the newly piece of drill string and the female end of the previous drill pipe is complete whereby the tongs 153 are released and the drilling operation continues.

When the drilling operation is completed and the initial hole through the desired ground is completed, a reamer may conveniently be substituted for the drill bit if hole enlargement is desired. As the drill string is removed from the hole, the reamer will enlarge the initial hole.

With regards to the operation of the directional drill during drill string removal, the process described above is simply reversed. That is, the rotary drill head 122 is moving with the drill pipe 131 is a reverse direction from that when the actual drilling operation is being conducted. Likewise, the male connector 130 is rotating the pipe 131 is a direction opposite to that during the original drilling operation.

The male connector 130 is removed from the pipe 131 by holding the pipe 131 with the tongs 134 and the gripper arms will move the removed pipe from is drilling position to the pipe rack 125.

It will be noted that during the drilling and removal operation, the hydraulic lines extending between manifold 133 and rotary drill head 122 and the drilling fluid line extending from the mud tank 160 to the rotary drill head 122 are moving with the rotary drill head 122 and the drilling. However, they are maintained an orderly and separated configuration by their position within the chain link 133 which follows the rotary drill head 122 and which is connected at one end to the rotary drill head 122 and on the other end to the frame of manifold 135.

Many modifications in the directional drill will readily occur to those skilled in the art to which the invention relates and the specific embodiments described lo should be taken as illustrative of the invention only and not as limiting its scope as defined in accordance with the accompanying claims.

We claim:

1. A self-powered and transportable directional drill having a longitudinal and generally horizontal axis extending the length of said directional drill for drilling a hole beneath the ground surface, said drill comprising a rotary drillhead with a connector for applying rotary motion to drill pipe extending along said longitudinal axis and for applying pressure on said drill pipe during said drilling along said longitudinal axis, said rotary drillhead moving from a first position wherein drill pipe is connected to said connector and a second position wherein said drill pipe is removed from, said connector, a first frame with a set of tires mounted on said first frame, said first frame having a first substantially longitudinal and horizontal axis, said rotary drillhead being mounted on a second frame, said second frame being mounted for rotational movement about said first substantially horizontal and longitudinal axis of said first frame during said rotary motion of said drill pipe along said longitudinal axis, said second frame being mounted only for said rotational movement about said longitudinal and generally horizontal axis of said directional drill during said drilling of said hole along said longitudinal axis.

2. Directional drill as in claim 1 and further including rail wheels operable to engage and disengage with railway track.

3. Directional drill as in claim 2 wherein said directional drill rests on a ground surface and has a drilling angle and whereas an adjustment member allows an increase or decrease of said drilling angle.

4. Directional drill as in claim 3 and further comprising a positioning member to move said directional drill between operating and transport conditions.

5. Directional drill as in claim 4 and further comprising hydraulic lines operable extending to said rotary drill head and movable therewith, said hydraulic lines being maintained in position with chain links.

6. Directional drill as in claim 5 and further comprising a drilling fluid tank associated with said rotary drill head, said drilling fluid tank having a fluid line extending to said rotary drill head.

7. Method of operating a directional drill comprising the steps of selecting an operating position of said directional drill having a first frame associated with pneumatic tires said first frame having a longitudinal axis, and a second frame associated with a rotary drill head, said second frame is rotated relative to said first fame about a longitudinal and generally horizontal axis of said directional drill and wherein said second frame in then more nearly in a horizontal position relative to said first frame when said first frame is not horizontal in said operating position and when said directional drill is drilling a hole along said longitudinal axis of said first frame.

8. Method as in claim 7 and further comprising transporting said directional drill to said operating position at least in part with a set of rail wheels associated with said directional drill.

9. Method as in claim 8 wherein said directional drill has a plurality of hydraulic lines associated with said rotary drill head, said method comprising maintaining said hydraulic lines in predetermined configurations during said operation of said directional drill.

10. Method as in claim 9 and further comprising moving said rotary drill head between transport and operating modes.

11. Method as in claim 10 and further comprising adjusting the angle of drilling of said directional drill.

* * * * *